United States Patent [19]

Haramoto

[11] 4,253,437

[45] Mar. 3, 1981

[54] FUEL CONTROL MEANS FOR INTERNAL COMBUSTION ENGINES

[75] Inventor: Tsutomu Haramoto, Hiroshima, Japan

[73] Assignee: Toyo Kogyo Co., Ltd., Hiroshima, Japan

[21] Appl. No.: 6,880

[22] Filed: Jan. 25, 1979

[30] Foreign Application Priority Data

Jan. 30, 1978 [JP] Japan ..... 53-10236[U]

[51] Int. Cl.[3] ..... F02M 11/00

[52] U.S. Cl. ..... 123/325; 123/350; 123/339; 192/3 R

[58] Field of Search ..... 123/97 R, 97 B, 102, 123/103 R, 119 D, 119 DB, 124 R, 124 B, 198 DB, DIG. 11; 192/3 R

[56] References Cited

U.S. PATENT DOCUMENTS

| | | | |
|---|---|---|---|
| 3,455,260 | 7/1969 | Mennesson | 123/97 B |
| 3,751,916 | 8/1973 | Hayashida et al. | 123/119 DB |
| 3,756,208 | 9/1973 | Toda et al. | 123/97 B |
| 3,799,301 | 3/1974 | Bentley | 192/3 R |
| 4,026,168 | 5/1977 | Kobayashi | 123/97 B |

FOREIGN PATENT DOCUMENTS

| | | | |
|---|---|---|---|
| 2730386 | 1/1979 | Fed. Rep. of Germany | 123/97 B |

*Primary Examiner*—Craig R. Feinberg
*Attorney, Agent, or Firm*—Fleit & Jacobson

[57] ABSTRACT

Engine fuel control system includes a slow fuel passage for providing a supply of fuel mostly under a light load engine operation. A solenoid type shut-off valve is provided in the slow fuel passage so that the fuel supply is cut-off during deceleration. The valve is opened when the engine speed is decreased to a certain value to recover the fuel supply. The engine speed under which the fuel supply is recovered is lower when the vehicle brake is actuated than that when the brake is not actuated.

9 Claims, 3 Drawing Figures

FUEL CONTROL MEANS FOR INTERNAL COMBUSTION ENGINES

The present invention relates generally to internal combustion engines and more particularly to fuel control means for internal combustion engines. More specifically, the present invention pertains to means for cutting-off supply of fuel during deceleration to thereby decrease the amounts of unburnt constituents in the exhaust gas simultaneously achieving an improved fuel economy.

It has already been proposed, for example, by the U.S. Pat. Nos. 2,840,359 and 3,486,594, to close slow fuel passages during deceleration of the engine so that supply of fuel is cut-off to thereby provide an improved fuel economy and decreased pollutant emissions. From the viewpoint of fuel economy and pollutant emissions, it is advisable to maintain the slow fuel passages closed until the engine speed is decreased to a substantially low value. However, such an arrangement provides another problem when it is desired to accelerate the engine after a certain period of deceleration. Since fuel supply is cut-off during deceleration, liquid fuel deposited on the intake passage wall in the form of a film flow has substantially been vaporized and taken into the combustion chamber in the deceleration period. Therefore, when the supply of fuel is re-started for acceleration, there will be a time lag before the fuel reaches the combustion chambers so that the engine does not quickly respond to the accelerating operation. Further, when the fuel reaches the combustion chambers after a certain time lag from the re-start of the fuel supply, there will be a sudden increase in the engine output producing an unsmooth feeling in acceleration.

In order to eliminate the above problems, there has been proposed by the U.S. Pat. No. 3,690,305 to provide, in addition to the slow fuel passages, auxiliary fuel passages which open to the intake passages downstream of the slow fuel passage ports so that fuel is supplied to the combustion chambers without any time lag as soon as the fuel supply is restarted. However, this proposal is not so advantageous as expected because it requires a complicated and expensive fuel system.

It is therefore an object of the present invention to provide engine fuel control means in which fuel supply is cut-off during deceleration of the engine but recovery of fuel supply can be accomplished without any time delay in acceleration after a certain period of deceleration.

Another object of the present invention is to provide engine fuel control means which is simple in construction and less expensive in manufacture.

According to the present invention, the above and other objects can be accomplished by fuel control means for vehicle engines comprising slow fuel passage means for providing supply of fuel for slow engine operation, valve means provided in said slow fuel passage means and having an open and closed position, means for sensing deceleration of the engine and actuating the valve means to close the slow fuel passage means when the engine deceleration is sensed, characterized by fuel supply recovery means for detecting that engine operating condition is below a first predetermined value, that the engine operating condition is below a second predetermined value which is lower than the first predetermined value and that vehicle brake means is actuated and actuating the valve means to the open position even under deceleration when the engine operating condition is below the first predetermined value and the vehicle brake means is not actuated and maintaining the valve means in the closed position when the vehicle brake means is actuated as far as the engine operating condition is above the second predetermined valve but moving the valve means to the open position when the engine is decelerated below the second predetermined value.

The engine operating condition may be detected in terms of the engine speed or the engine intake suction pressure. Alternatively, the engine operating condition may be represented by the speed of vehicle on which the engine is mounted. In one aspect of the present invention, the recovery means includes first fuel supply recovery means which includes means for sensing that the engine operating condition is below the first predetermined value and actuated valve means to the open position when the engine operating condition is below the first predetermined value, second fuel supply recovery means including means for sensing that the engine operating condition is below the second predetermined value and actuating the valve means to the open position when the engine operating condition is below the first predetermined value, and means for sensing actuation of the vehicle brake means and cancelling operation of the first fuel supply recovery means when the vehicle brake means is actuated.

According to another aspect of the present invention, the actuation of the valve means is controlled by comparator means which is adapted to compare a signal representing the engine operating condition with a reference signal and means is provided for changing the level of the reference signal when the vehicle brake means is actuated so that the valve means is not opened until the engine is decelerated to the second predetermined value. In a preferable mode of the present invention, the first predetermined value of the engine operating condition may be 2,000 rpm of the engine speed or equivalent thereto and the second predetermined value may be 1,000 rpm or equivalent thereto. Further, means may additionally be provided for sensing actuation of vehicle clutch means so that the valve means is opened whenever the clutch means is disengaged.

The above and other objects and features of the present invention will become apparent from the following descriptions of preferred embodiments taking reference to the accompanying drawings, in which.

Figure 1:
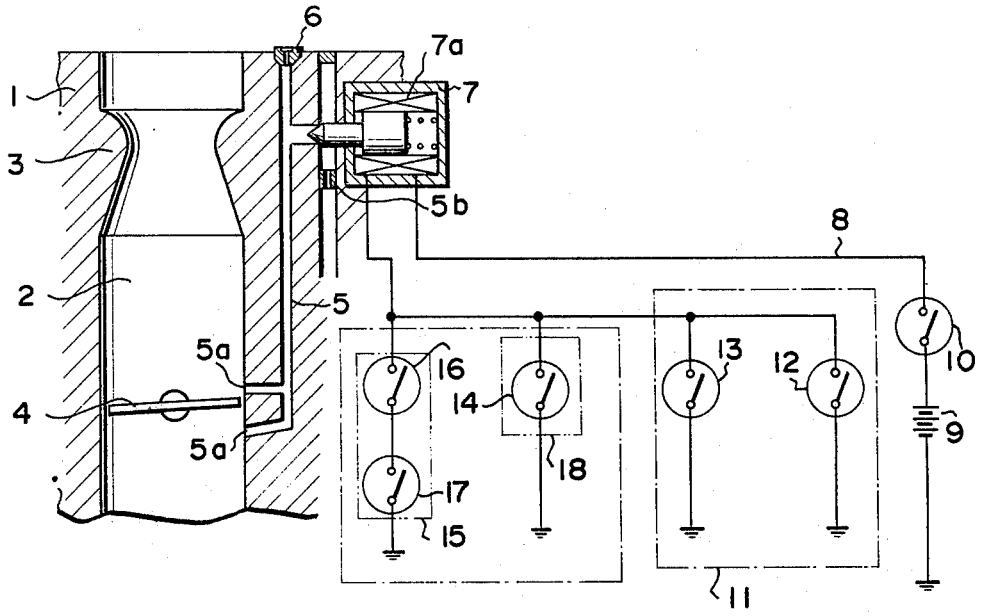
FIG. 1 is a fragmentary sectional view schematically showing an engine fuel control system in accordance with one embodiment of the present invention.

Referring now to the drawings, particularly to FIG. 1, the fuel control system shown therein includes a carburetor body 1 formed with an intake passage 2 which leads to an engine combustion chamber (not shown). As well known in the art, the intake passage 2 has a venturi portion 3 formed therein and a throttle valve 4 is provided in the intake passage 2 downstream of the venturi portion 3.

In the carburetor body 1, there is further formed a slow fuel passage 5 which is communicated at one end through a jet orifice **5*b* with a float chamber (not shown) and at the other end with slow fuel ports 5*a*** opening to the intake passage 2 in the vicinity of the throttle valve 4. In order to introduce bleed air into the slow fuel passage 5, there is provided an air bleed orifice 6. The slow fuel passage 5 is provided with an electromagnetically operated solenoid valve 7 which is of a normally closed type and adapted to open the passage 5 when the solenoid valve 7 is energized. The solenoid valve 7 has a solenoid coil *7a* which is adapted to be energized through a line 8 from an electric power source 9. The line 8 connects the source 9 to the coil *7a* through a main or ignition switch 10 and the coil *7a* is grounded through parallel connected switches 12, 13 and 14. The switch 12 is of a normally open type and associated with a transmission of a vehicle on which the engine is mounted so that it is closed when the transmission is in the neutral position. The switch 13 which is also of a normally open type is associated with the throttle valve 4 or a member for actuating the throttle valve 4 so that it is closed when the throttle valve 4 is opened. The switch 14 may be referred to as a second speed sensing switch and adapted to be closed when the engine speed is below a second predetermined value, for example, 1,000 rpm. The switches 12 and 13 together constitutes a deceleration sensing device 11.

It should therefore be noted that when the vehicle is running with the transmission in out-of-neutral position and with the throttle valve 4 in partly or widely open position, the switch 12 is opened but the switch 13 is closed to energize the coil *7a* of the solenoid valve 7. Therefore, the slow fuel passage 5 is opened to provide a supply of fuel whenever required. As long as the engine speed is above the second predetermined value, that is, 1,000 rpm, the switch 14 is opened. When the throttle valve 4 is then closed for deceleration, the switch 13 is opened to thereby deenergize the solenoid *7a* of the valve 7 and close the slow fuel passage 5 so that the fuel supply is cut-off. When the engine speed is decreased below the second predetermined value, the switch 14 is closed so that the solenoid *7a* of the valve 7 is energized to open the slow fuel passage 5. Thus, it will be understood that the switch 14 constitutes a fuel supply recovery device 18.

In the illustrated embodiment of the present invention, the solenoid *7a* of the valve 7 is also grounded through a further fuel supply recovery device 15 comprised of switches 16 and 17 which are connected in series. The switch 16 may be referred to as a first speed switch and adapted to be closed when the engine speed is below a first predetermined value which is higher than the second predetermined value. For the purpose of a specific example, the first predetermined value may be 2,000 rpm of the engine speed. The switch 17 is associated with a vehicle brake system in such a manner that it is closed when the vehicle brake is not in operation but opened when the brake is actuated.

Thus, it will be understood that, when the throttle valve 4 is closed for deceleration but the vehicle brake is not actuated, the energizing circuit for the solenoid *7a* is completed through the switches 16 and 17 as soon as the engine speed is decreased below the first predetermined value, for example, 2,000 rpm to thereby re-start the supply of fuel through the slow fuel passage 5. Therefore, when the throttle valve 4 is opened, the engine is immediately accelerated without delay.

Figure 2:
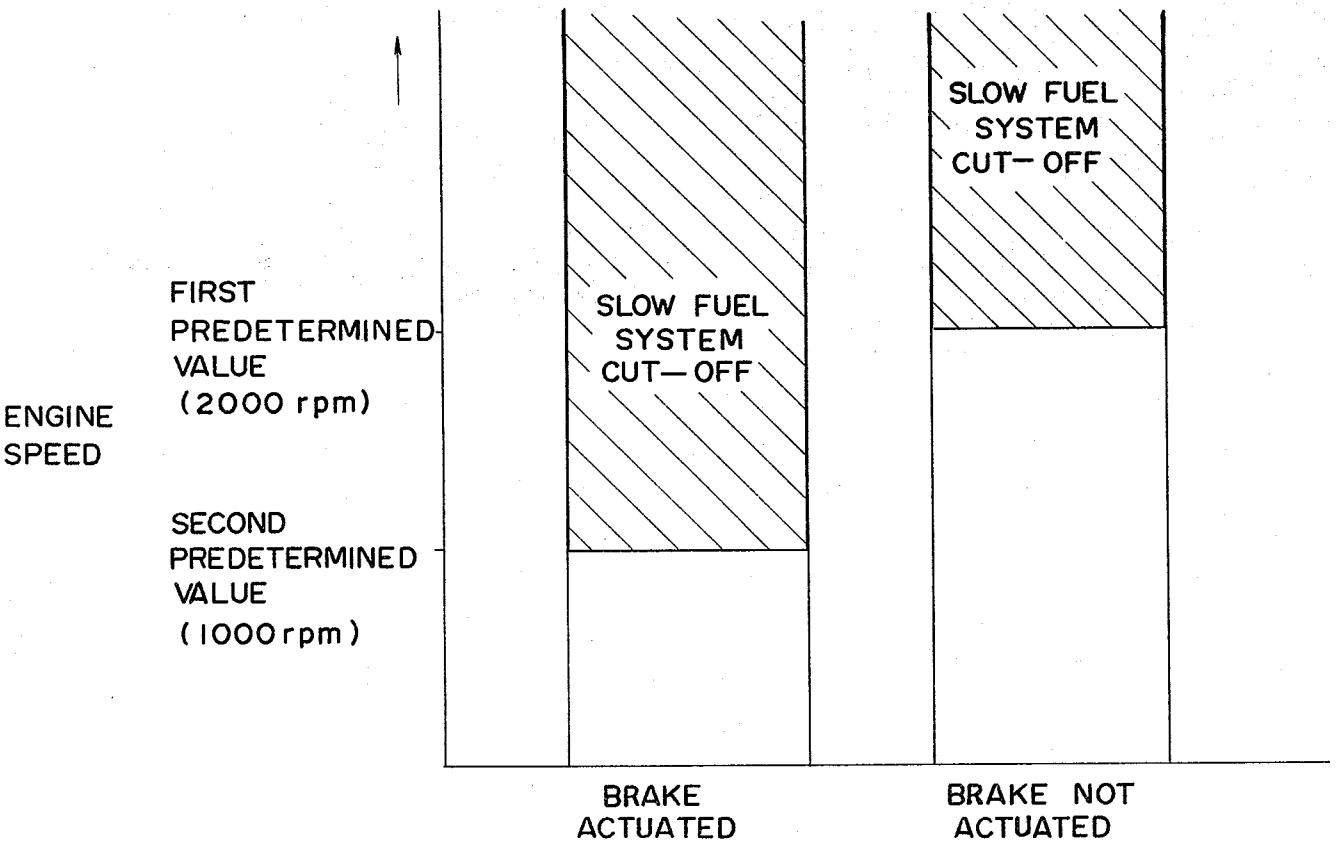
FIG. 2 is a diagram showing fuel cut-off in decelerating operation.

If the vehicle brake is actuated with the throttle valve 4 in the closed position, the switch 17 is opened so that the fuel supply recovery is controlled only through the switch 14. Therefore, the fuel supply is restarted only when the engine speed is decreased below the second predetermined value, for example, 1,000 rpm. Thus, the fuel cut-off during deceleration and the recovery of the fuel supply are controlled as shown in FIG. 2.

Figure 3:
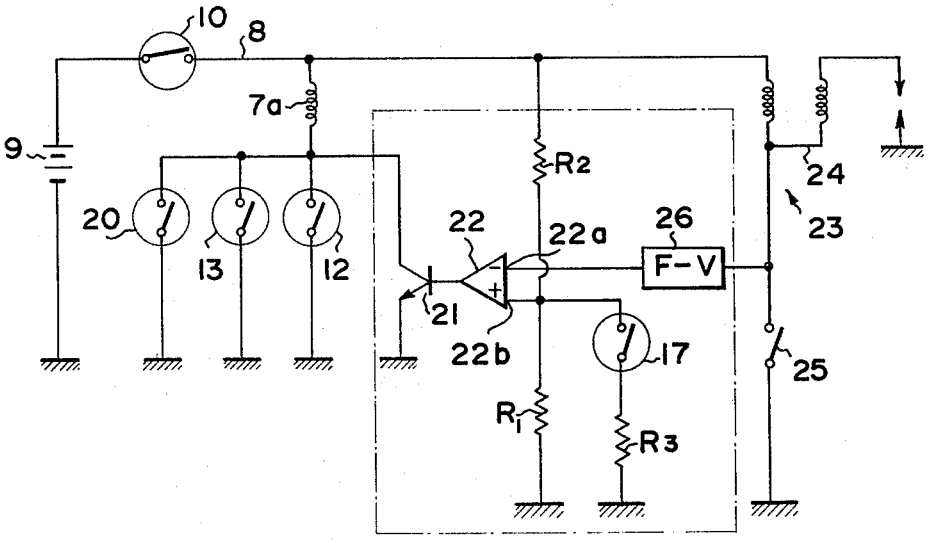
FIG. 3 is an electrical circuit diagram showing an engine control system in accordance with another embodiment of the present invention.

In the embodiment shown in FIG. 3, the solenoid coil *7a* is connected at one end with an electric power source 9 through a main or ignition switch 10 and grounded at the other end through parallel connected switches 12 and 13 which function as the switches 12 and 13 in the previous embodiment. The solenoid coil *7a* is also grounded through a switch 20 which is associated with the vehicle clutch device so that it is closed when the clutch device is disengaged.

The solenoid coil *7a* is further grounded through a switching transistor 21 which has a collector connected with the solenoid coil *7a* and an emitter connected with ground. The transistor 21 further has a base which is connected with the output of a comparator 22 having a signal input **22*a* and a reference input 22*b*. The signal input 22*a* is connected through a frequency-voltage transducer 26 with an engine ignition control circuit 23 including an ignition coil 24 and a braker 25. Thus, the voltage signal applied to the signal input 22*a*** is changed in accordance with the engine speed.

The reference input **22*b* is grounded on one hand through a resistor $R_1$ and on the other hand connected with the power line through a resistor $R_2$. Further, the input 22*b* is grounded through a switch 17 and a resistor $R_3$. The switch 17 is associated with the vehicle brake system so that it is closed when the brake system is in operation. The comparator provides an output signal when the input signal at the input 22*a* is smaller than the reference voltage at the input 22*b* to turn the transistor 21** on.

When the vehicle is running in normal condition, the throttle valve switch 13 is closed to energize the solenoid coil *7a* and to thereby open the slow fuel passage. When the throttle valve is then closed for deceleration, the switch 13 is opened so that the solenoid coil *7a* is de-energized to cut-off the supply of fuel. If the vehicle brake system is not in operation, the switch 17 is opened so that the reference voltage at the input **22*b* is at a higher level. Therefore, when the engine speed is decreased below a first predetermined value, for example 2,000 rpm, an output is produced at the comparator 22 to turn the transistor 21 on. Thus, the fuel supply is recovered at the first predetermined value of the engine speed. If the vehicle brake system is in operation, the switch 17 is closed so that the reference voltage at the input 22*b* is at a lower level. Therefore, the comparator 22 produces an output when the engine speed is decreased below a second predetermined value, for example, 1,000 rpm, which is lower than the first predetermined value. In the embodiment shown in FIG. 3**, the solenoid coil *7a* is also energized through the switch 20 when the vehicle clutch device is disengaged.

From the above descriptions, it will be understood that, in accordance with the present invention, the supply of fuel is cut-off when the engine is decelerated and such fuel cut-off is continued until the engine speed is decreased to a substantially low level, such as 1,000 rpm, as far as the vehicle brake system is actuated. Thus, it is possible to attain good results in respect of fuel economy and pollutant emissions. However, if the brake system is not actuated during deceleration, since there is a higher possibility of reacceleration, the recovery of fuel supply is effected at a relatively high engine speed, such as 2,000 rpm, so that the engine can be accelerated without delay.

The invention has thus been shown and described with reference to specific embodiments, however, it should be noted that the invention is in no way limited to the details of the illustrated arrangements but changes and modifications may be made without departing from the scope of the appended claims.

I claim:

1. Fuel control means for vehicle engines which comprises slow fuel passage means for providing supply of fuel for slow engine operation, valve means provided in said slow fuel passage means and having an open and closed position, means for sensing deceleration of the engine and actuating the valve means to close the slow fuel passage means when the engine deceleration is sensed, characterized by fuel supply recovery means for detecting whether an engine operating condition is below a first predetermined value, whether the engine operating condition is below a second, lower predetermined value which is closer to engine idling condition than the first predetermined value and whether vehicle brake means is actuated and maintaining the valve means in the closed position when the vehicle brake means is actuated as long as the engine operating condition is above the second predetermined value and moving the valve means to the open position when the engine is decelerated either below the second predetermined value independent of brake means actuation or between the first and second predetermined values when the vehicle brake means is not actuated.

2. Fuel control means in accordance with claim 1 in which said fuel supply recovery means includes means for sensing engine speed to detect that the engine speed is below the first and second predetermined values.

3. Fuel control means in accordance with claim 1 in which said recovery means includes first fuel supply recovery means which includes means for sensing that the engine operating condition is below the first predetermined value and actuating valve means to the open position when the engine operating condition is below the first predetermined value, second fuel supply recovery means including means for sensing that the engine operating condition is below the second predetermined value and actuating the valve means to the open position when the engine operating condition is below the first predetermined value, and means for sensing actuation of the vehicle brake means and cancelling operation of the first fuel supply recovery means when the vehicle brake means is actuated.

4. Fuel control means in accordance with claim 2 in which said valve means is of an electromagnetic solenoid type and said first and second recovery means include circuit means for energizing the solenoid type valve means, said sensing means in the first and second recovery means respectively including switch means in said circuit means, the switch means in the first and second recovery means being adapted to be actuated respectively at the first and second engine operating conditions.

5. Fuel control means in accordance with claim 4 in which said solenoid type valve means is of a normally closed type and adapted to be opened when it is energized, said switch means in said first and second recovery means being of such types that are closed when the engine operating conditions are below the first and second engine operating conditions, respectively, said cancelling means including switch means which is opened when the vehicle brake means is actuated and connected in series with the switch means of the first recovery means.

6. Fuel control means in accordance with claim 1 in which said recovery means includes comparator means for comparing a signal representing the engine operating condition with a reference signal and producing a change in output when the engine operating condition signal is at a predetermined relationship with respect to the reference signal, means for changing level of the reference signal when the vehicle brake means is actuated, means responsive to the output of the comparator means for actuating the valve means when there is said change in the output of the comparator means.

7. Fuel control means in accordance with claim 6 in which said valve means is of an electro-magnetic solenoid type and said output responsive means includes switch means in circuit means for energizing the valve means, said switch means being actuated when there is a change in the output of the comparator means.

8. Fuel control means in accordance with claim 6 in which said recovery means includes parallel connected resistors for providing said reference signal, said level changing means including switch means connected in series with one of the resistors and being actuated when the vehicle brake means is actuated.

9. Fuel control means for vehicle engines which comprises slow fuel passage means for providing supply of fuel for slow engine operation, solenoid valve means provided in said slow fuel passage means and having an open and closed position, control means for said valve means, said control means including means for sensing a closed position of engine throttle valve means, whether the engine is above a first predetermined engine speed, whether the engine is above a second predetermined engine speed which is lower than the first predetermined engine speed but higher than engine idling speed, and an actuation of vehicle brake means and means for moving the solenoid valve means to the closed position only when the throttle valve means is closed and the engine is above the first predetermined speed independent of brake means actuation or when the throttle valve means is closed and the brake means is actuated only when the engine is above the second predetermined speed.

* * * * *